US012319535B1

(12) United States Patent
Graham et al.

(10) Patent No.: US 12,319,535 B1
(45) **Date of Patent: *Jun. 3, 2025**

(54) REEL TAKE-UP MACHINE

(71) Applicant: Reeling Systems L.L.C., Kimball, MI (US)

(72) Inventors: Donald G. Graham, St. Clair, MI (US); Christopher L. Graham, Allenton, MI (US)

(73) Assignee: Reeling Systems L.L.C., Kimball, MI (US)

( * ) Notice: Subject to any disclaimer, the term of this patent is extended or adjusted under 35 U.S.C. 154(b) by 154 days.

This patent is subject to a terminal disclaimer.

(21) Appl. No.: 18/122,402

(22) Filed: Mar. 16, 2023

Related U.S. Application Data

(63) Continuation-in-part of application No. 17/220,164, filed on Apr. 1, 2021, now Pat. No. 11,643,297.

(51) Int. Cl.

| | |
|---|---|
| ***B65H 54/54*** | (2006.01) |
| ***B65H 54/12*** | (2006.01) |
| ***B65H 54/28*** | (2006.01) |
| ***B65H 54/44*** | (2006.01) |
| ***B65H 61/00*** | (2006.01) |
| ***B65H 67/04*** | (2006.01) |

(52) U.S. Cl.
CPC ..... *B65H 54/543* (2013.01); *B65H 54/28* (2013.01); *B65H 54/44* (2013.01); *B65H 61/00* (2013.01); *B65H 67/0411* (2013.01); *B65H 67/0417* (2013.01); *B65H 54/12* (2013.01); *B65H 2404/1441* (2013.01); *B65H 2404/152* (2013.01); *B65H 2405/454* (2013.01); *B65H 2601/124* (2013.01); *B65H 2701/34* (2013.01)

(58) Field of Classification Search
CPC ..... B65H 75/42; B65H 75/4402; B65H 75/4421; B65H 49/16; B65H 49/34; B65H 49/38; B65H 49/325; B65H 49/327; B66F 3/10; B66F 9/12; B66F 9/18; B66F 9/07522
See application file for complete search history.

(56) References Cited

U.S. PATENT DOCUMENTS 11,643,297 B1 * 5/2023 Graham ..... B65H 54/44 242/557

* cited by examiner

*Primary Examiner* — William A. Rivera
(74) *Attorney, Agent, or Firm* — Robert M. Miller

(57) ABSTRACT

A reel take-up apparatus includes a frame, a drive mechanism, a hydraulic counterbalance system, and a pair of positioning actuators. The frame may be configured to receive a reel from one end. The drive mechanism is generally slidably mounted to the frame and configured to rotate the reel. The hydraulic counterbalance system is generally configured to counterbalance a weight of the drive mechanism to allow the drive mechanism to float freely on the frame. The pair of positioning actuators may be configured to move a pair of support rollers toward and away from each other so as to (i) lift the reel from a support surface, (ii) support the reel during rotation by the drive mechanism, and (iii) lower the reel to the support surface for removal from the frame.

20 Claims, 14 Drawing Sheets

DETAIL B

REEL TAKE-UP MACHINE

This application relates to U.S. patent application Ser. No. 17/220,164, filed Apr. 1, 2021, which is hereby incorporated by reference in its entirety.

FIELD OF THE INVENTION

The invention relates to cable winding machines generally and, more particularly, to a method and/or apparatus for implementing a reel take-up machine.

BACKGROUND

Because cable is generally purchased in bulk on large reels weighing as much as 20,000 pounds, it is generally necessary that cable handling equipment be capable of transferring the cable from a very large reel, as provided by the manufacturer, to a smaller reel which the end user can more easily transport for field applications and handle for use in manufacturing applications. This is particularly true where the cable is very large and bulky, such as copper electrical service cables installed in the field by electricians and electrical utilities.

It would be desirable to implement a reel take-up machine.

SUMMARY

The invention concerns a reel take-up apparatus comprising a frame, a drive mechanism, a hydraulic counterbalance system, and a pair of positioning actuators. The frame may be configured to receive a reel from one end. The drive mechanism is generally slidably mounted to the frame and configured to rotate the reel. The hydraulic counterbalance system is generally configured to counterbalance a weight of the drive mechanism to allow the drive mechanism to float freely on the frame. The pair of positioning actuators may be configured to move a pair of support rollers toward and away from each other so as to (i) lift the reel from a support surface, (ii) support the reel during rotation by the drive mechanism, and (iii) lower the reel to the support surface for removal from the frame.

BRIEF DESCRIPTION OF THE FIGURES

Embodiments of the invention will be apparent from the following detailed description and the appended claims and drawings.

DETAILED DESCRIPTION OF THE EMBODIMENTS

Embodiments of the present invention include providing a reel take-up machine that may (i) allow a single operator to load and unload a reel, (ii) support a reel using flanges of the reel instead of an axle, (iii) allow a reel to be loaded from one side while the reel is sitting on a surface, (iv) lift a reel after being loaded for winding or unwinding, (v) be rolled up to a reel like a hand truck, and/or (vi) allow the operator to easily attach one or more cables to the reel in preparation for winding.

In various embodiments, a reel take-up apparatus is provided for handling a reel (or spool) having a barrel (or core) about which a wire or cable is wound and two flanges, one at each end of the barrel. The reel take-up apparatus generally includes a frame, a pair of roller assemblies, a drive mechanism, and a shaft that is connected at only one end. Each roller assembly is generally mounted to an elongated frame member. The roller assemblies are configured to be moved toward and away from one another. The shaft is connected at the one end to the drive mechanism for rotating the reel. An unconnected end of the shaft is configured to spear a center arbor hole of a reel. A roller of each roller assembly is rotatably supported at each end. The roller assemblies are arranged so that a rotational axis of each roller of each roller assembly is substantially parallel to one another and to a rotational axis of the reel. A positioning actuator (e.g., a scissor jack mechanism, etc.) may be coupled between each elongated frame member and each roller assembly. The positioning actuators are generally configured to move the rollers of each roller assembly toward and away from one another. By positioning the rollers adjacent to the flanges of the reel and then moving the rollers toward one another, the reel may be raised to an elevated position above the floor. The rollers allow the reel to be rotated by the drive mechanism.

Figure 1:
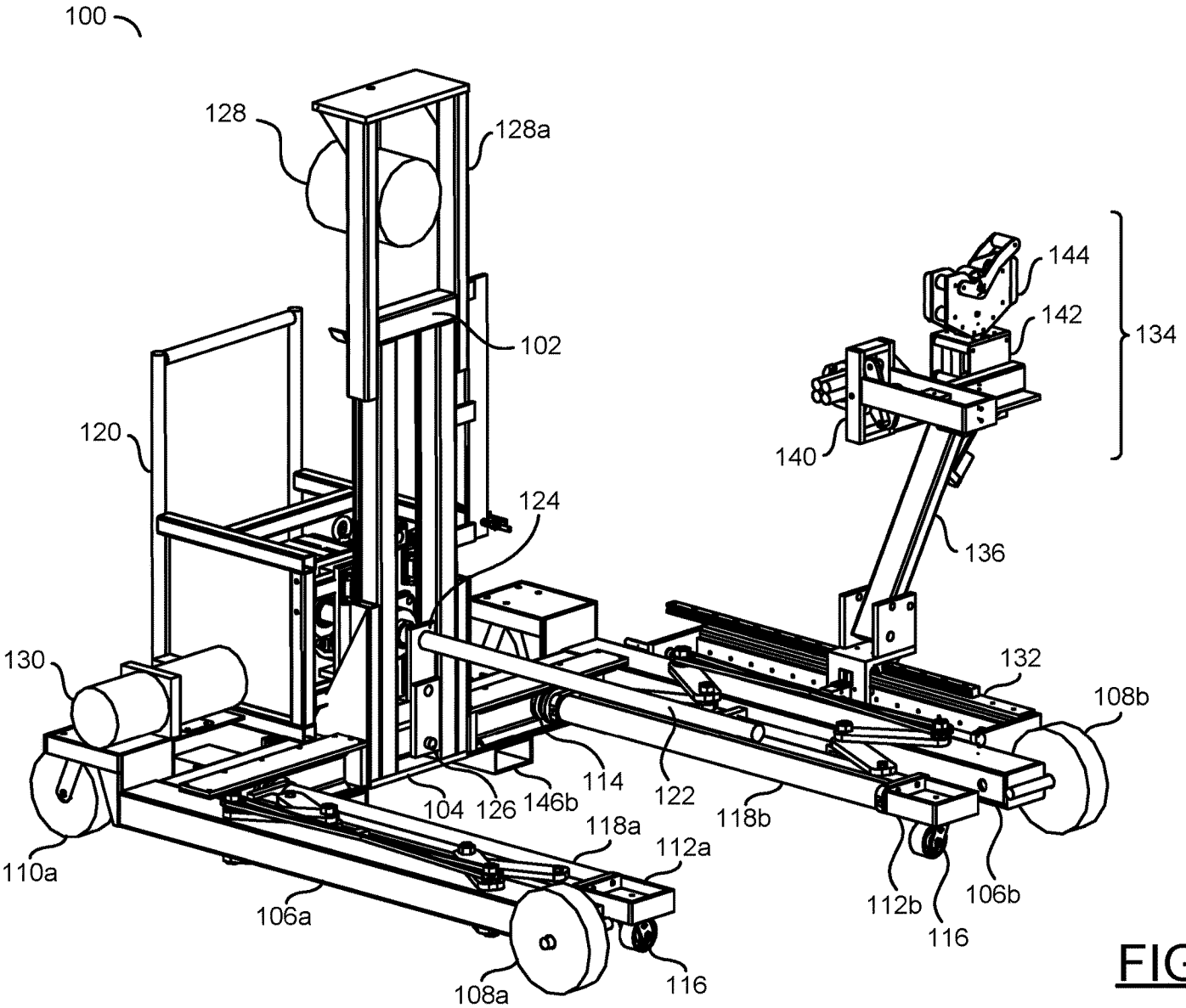
FIG. 1 is a diagram illustrating a reel take-up apparatus in accordance with an example embodiment of the invention.

Referring to FIG. 1, a diagram is shown illustrating a reel take-up apparatus (or machine) 100 in accordance with an example embodiment of the invention. In an example embodiment, the reel take-up apparatus 100 generally comprises a vertical frame member (or mast) 102, a frame cross member 104, a right bottom frame member 106*a*, and a left bottom frame member 106*b*. The vertical frame member 102 extends vertically from a center portion of the frame cross member 104. The right bottom frame member 106*a* extends horizontally away at a right angle from a first end of the frame cross member 104. The left bottom frame member 106*b* extends horizontally away at a right angle from a second end of the frame cross member 104. The right bottom frame member 106*a* and the left bottom frame member 106*b* generally extend in the same direction from the frame cross member 104.

A right front caster 108*a* is generally attached to an end of the right bottom frame member 106*a* that is distal from the frame cross member 104. A left front caster 108*b* is generally attached to an end of the left bottom frame member 106*b* that is distal from the frame cross member 104. A right rear caster assembly 110*a* is generally attached to a second end of the right bottom frame member 106*a* adjacent to the frame cross member 104. A left rear caster assembly 110*b* (not visible) is generally attached to a second end of the left bottom frame member 106*b* adjacent to the frame cross member 104. The right rear caster assembly 110*a* and the left rear caster assembly 110*b* are generally configured as swivel casters to allow the reel take-up apparatus 100 to be easily maneuvered.

In various embodiments, the frame cross member 104, the right bottom frame 106*a*, and the left bottom frame member 106*b* are generally configured as non-moving structural components of a roller assembly of the reel take-up apparatus 100. In various embodiments, the roller assembly of the reel take-up apparatus 100 generally comprises the frame cross member 104, a right side roller sub-assembly, and a left side roller sub-assembly. The right side roller sub-assembly generally comprises the right bottom frame member 106*a* and a right push bar assembly 112*a*. The left side roller sub-assembly generally comprises the left bottom frame member 106*b* and a left push bar assembly 112*b*.

A first end of the right push bar assembly 112*a* and a first end of the left push bar assembly 112*b* are generally slidably attached to the frame cross member 104 by v-groove rollers 114. The right push bar assembly 112*a* generally extends away from the frame cross member 104 parallel with the right bottom frame member 106*a*. The left push bar assembly 112*b* generally extends away from the frame cross member 104 parallel with the left bottom frame member 106*b*. A second end of the right push bar assembly 112*a* that is distal from the frame cross member 104 is generally supported by a first swivel caster 116. Similarly, a second end of the left push bar assembly 112*b* that is distal from the frame cross member 104 is generally supported by a second swivel caster 116.

The right push bar assembly 112*a* is generally coupled to the right bottom frame member 106*a* by a positioning actuator assembly (e.g., a scissor jack mechanism, etc.). In an example, the positioning actuator assembly may comprise a hydraulic cylinder configured to move the right push bar assembly 112*a* relative to the right bottom frame member 106*a*. The positioning actuator assembly is generally configured, in a first mode, to move the right push bar assembly 112*a* away from the right bottom frame member 106*a* and, in a second mode, to move the right push bar assembly 112*a* toward the right bottom frame member 106*a*. The right push bar assembly 112*a* further comprises a roller 118*a*. The roller 118*a* is generally coupled to the right push bar assembly 112*a* such that an axis of the roller 118*a* is parallel to the right push bar assembly 112*a*.

The left push bar assembly 112*b* is generally coupled to the left bottom frame member 106*b* by a second positioning actuator assembly (e.g., a scissor jack mechanism, etc.). In an example, the second positioning actuator assembly may comprise a second hydraulic cylinder configured to move the left push bar assembly 112*b* relative to the left bottom frame member 106*b*. The positioning actuator assembly is generally configured, in a first mode, to move the left push bar assembly 112*b* away from the left bottom frame member 106*b* and, in a second mode, to move the left push bar assembly 112*b* toward the left bottom frame member 106*b*. The left push bar assembly 112*b* further comprises a roller 118*b*. The roller 118*b* is generally coupled to the left push bar assembly 112*b* such that an axis of the roller 118*b* is parallel to the left push bar assembly 112*b*.

In various embodiments, the reel take-up apparatus 100 generally further comprises a modular push handle assembly 120. The modular push handle assembly 120 generally provides a handle for use by an operator to maneuver the reel take-up apparatus 100 and encloses a drive mechanism that is slidably attached to the vertical frame member 102. The drive mechanism is further connected to a first end of a shaft 122. A second end of the shaft 122 is generally left unconnected and configured to be placed through a center arbor hole of a reel (not shown for clarity) upon which wire/cable is to be wound. The shaft 122 is generally further configured to allow the reel to be driven by the drive mechanism attached to the first end of the shaft 122.

In an example, a knuckle arm assembly 124 is attached (e.g., welded, splined, etc.) to the shaft 122 near the vertical frame member 102. The knuckle arm assembly 124 is generally configured to be coupled to a reel by a drive pin 126 (described below in connection with FIGS. 7 and 8). In an example, the drive pin 126 passes through a hole in the knuckle arm assembly 124 and into a drive hole of the reel. The knuckle arm assembly 124 is generally configured to adjust to variations of a position of the drive hole between different reels.

In various embodiments, the reel take-up apparatus 100 further comprises a tool balancer 128. A frame 128*a* supporting the tool balancer 128 may be mounted at or near a top end of the vertical frame member 102. The tool balancer 128 is generally coupled to the drive mechanism slidably attached to the vertical frame member 102. The tool balancer 128 is generally configured to act as a counterbalance for the weight of the drive mechanism. The tool balancer 128 generally allows the drive mechanism to float freely on the vertical frame member 102, allowing the drive mechanism to move up and down as a reel attached to the reel take-up apparatus 100 moves up and down.

In various embodiments, the reel take-up apparatus 100 generally further comprises a hydraulic motor 130. The hydraulic motor 130 may be mounted at or near a rear right corner of the reel take-up apparatus 100. The hydraulic motor 130 is generally coupled to the positioning actuators of the right side and the left side roller sub-assemblies. The hydraulic motor 130 is generally configured to provide power to lift and lower the reel in a controlled manner.

In various embodiments, the reel take-up apparatus 100 may further comprise a slide wire traverse base (or wire traverse or carriage assembly or level wind) 132. In an example embodiment, the slide wire traverse base 132 may be mounted on a side of the left bottom frame member 106*b* opposite the left push bar assembly 112*b*. In an example, a wire handling assembly 134 is generally attached to the slide wire traverse base 132 by an extension arm 136. The slide wire traverse base 132 is generally configured to move the wire handling assembly 134 back and forth between flanges of a reel mounted on the reel take-up apparatus 100 to facilitate efficient winding of wire/cable on the barrel (or core) of the reel. In an example, the slide wire traverse base 132 may comprise a lead screw and square nut drive mechanism allowing the extension arm 136 to change direction as the wire/cable is being wound. In an example, the wire handling assembly 134 may comprise a wire clamp 140, a wire guide 142, and a wire measurement assembly 144. The slide wire traverse base 132, the extension arm 136, the wire clamp 140, the wire guide 142, the wire measurement assembly 144 may be implemented using conventional devices and/or techniques.

Figure 2:
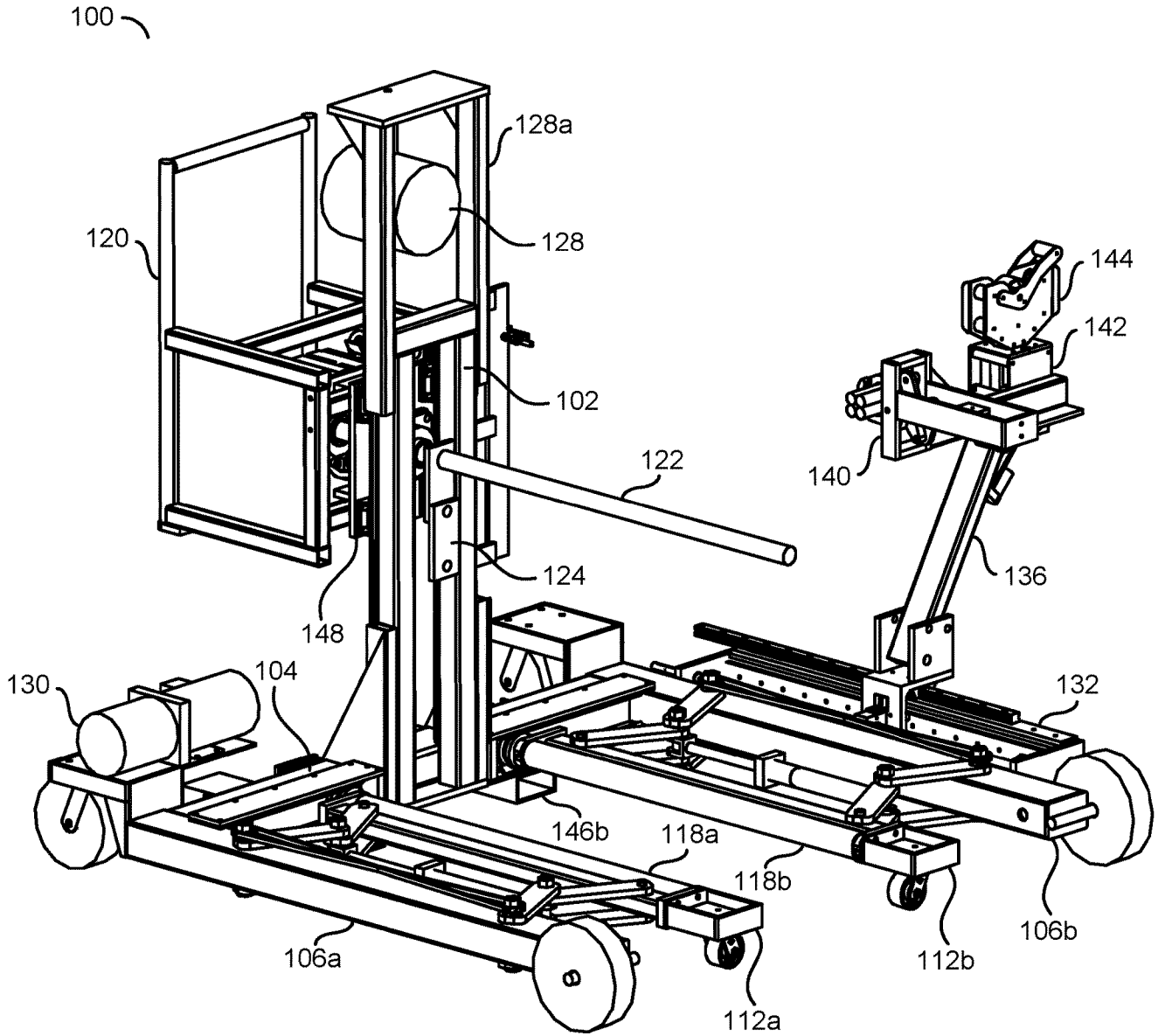
FIG. 2 is a diagram illustrating an arrangement of the reel take-up apparatus in accordance with an example embodiment of the invention when a reel (not shown) is being driven.

Referring to FIG. 2, a diagram is shown illustrating an arrangement of the reel take-up apparatus 100 of FIG. 1 when a reel is being driven. The reel take-up apparatus 100 is illustrated with the reel omitted for clarity in showing the components of the reel take-up apparatus 100. In an example, an operator may load a reel onto the reel take-up apparatus 100 using the modular push handle assembly 120. In another example, an operator may utilize a pallet truck, which may be attached to the reel take-up apparatus 100 by a couple of fork pockets 146*a* and 146*b* attached to the frame cross member 104.

When a reel is loaded onto the reel take-up apparatus 100, the modular push handle assembly 120, the enclosed drive mechanism, and the shaft 122 slide up the vertical frame member 102 as the reel is lifted off the floor by extension of the right and left push bar assemblies 112*a* and 112*b* away from the respective right and left bottom frame members 106*a* and 106*b*. In an example, the modular push handle assembly 120, the enclosed drive mechanism, and the shaft 122 are attached to a slide mount plate 148, which is slidably attached to the vertical frame member 102. In an example, the slide mount plate 148 may comprise four traverse bearings (e.g., one at each corner), which may be slidably attached to rail bearings on each vertical rail (or tube) of the vertical frame member 102. The four traverse bearings and two rail bearings generally allow the drive mechanism to float freely on the vertical frame member 102, allowing the bevel geared motor 160 to move up and down as a reel attached to the reel take-up apparatus 100 moves up and down. In an example embodiment, the right and left push bar assemblies 112*a* and 112*b* are extended away from the respective right and left bottom frame members 106*a* and 106*b* by expanding respective scissor jack mechanisms coupled (i) between the right push bar assembly 112*a* and the right bottom frame member 106*a* and (ii) between the left push bar assembly 112*b* and the left bottom frame member 106*b*. In an example embodiment, each scissor jack mechanism may comprise a hydraulic cylinder and eight spreader bars (described below in connection with FIG. 4).

Figure 3:
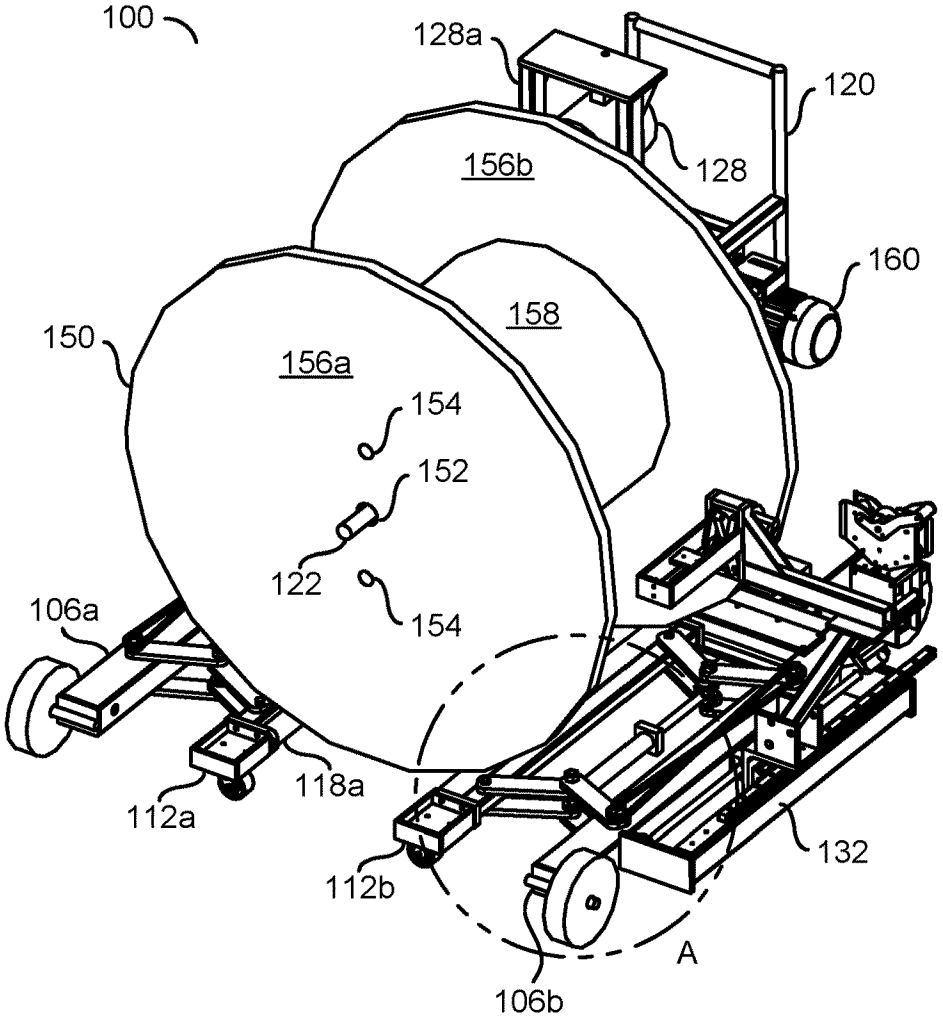
FIG. 3 is a diagram illustrating an actuator mechanism of the reel take-up apparatus in accordance with an example embodiment of the invention.

Referring to FIG. 3, a diagram is shown illustrating right and left positioning actuator mechanisms (or assemblies) of the reel take-up apparatus 100 in accordance with an example embodiment of the invention. The right and left positioning actuator mechanisms are generally illustrated in an extended position. Placing the right and left positioning actuator mechanisms in the extended position allows the reel 150 to be driven. In an example, when a reel 150 is loaded onto the reel take-up apparatus 100, the shaft 122 passes through a center arbor hole 152 of the reel 150 and extends some distance beyond an outside surface of the reel 150. The portion of the shaft 122 extending beyond the outside surface of the reel 150 generally allows a locking collar (not shown) to be assembled to the shaft 122 to lock the reel 150 onto the reel take-up apparatus 100 and allow the reel 150 to be driven by the drive mechanism of the reel take-up apparatus 100. In an example embodiment, the reel 150 generally comprises two flanges 156*a* and 156*b* located on opposite ends of a barrel (or core) 158. In general, the two flanges 156*a* and 156*b* of the reel 150 generally have a center arbor hole 152 and one or more drive holes 154 that are offset from the center arbor hole and in communication with an interior space of the core 158 of the reel 150. The one or more drive holes 154 may be engaged by the drive pin 126 connected to the knuckle arm assembly 124.

When the reel 150 is loaded and locked onto the reel take-up apparatus 100, the right and left push bar assemblies 112*a* and 112*b* may be extended to force the respective rollers 118*a* and 118*b* under the flanges 156*a* and 156*b* of the reel 150. The reel 150 is lifted off a surface (e.g., a floor) by the rollers 118*a* and 118*b* moving under the flanges 156*a* and 156*b*. The rollers 118*a* and 118*b* generally support the flanges 156*a* and 156*b* of the reel 150 allowing the reel 150 to be driven (e.g., rotated) by the drive mechanism mounted on the vertical frame member 102. In various embodiments, the drive mechanism generally comprises a bevel geared motor 160. In an example, the bevel geared motor 160 generally comprises a motor and a gear box (hidden).

A detail A is shown highlighting an example embodiment of a positioning actuator assembly (e.g., a scissor jack mechanism) that may be coupled (i) between the right push bar assembly 112*a* and the right bottom frame member 106*a* and (ii) between the left push bar assembly 112*b* and the left bottom frame member 106*b*. In an example embodiment, each scissor jack mechanism may comprise eight spreader bars 162 and a hydraulic cylinder 164 (described below in connection with FIG. 4).

Figure 4:
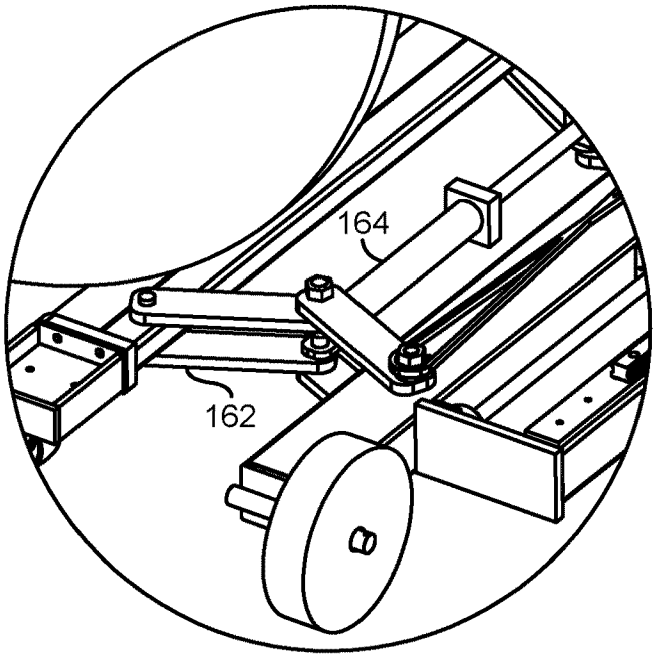
FIG. 4 is a diagram illustrating an actuator mechanism of the reel take-up apparatus in accordance with an example embodiment of the invention.

Referring to FIG. 4, an enlarged diagram of the detail A of FIG. 3 is shown illustrating a positioning actuator mechanism of the reel take-up apparatus 100 in the extended position. In an example embodiment, a scissor jack mechanism may comprise eight spreader bars 162 and a hydraulic cylinder 164. A first pair of spreader bars 162 may have a first end coupled to a first end of the left bottom frame member 106*b* and a second end coupled to a first end of the hydraulic cylinder 164. A second pair of spreader bars 162 may have a first end coupled to a second end of the left bottom frame member 106*b* and a second end coupled to a second end of the hydraulic cylinder 164. A third pair of spreader bars 162 may have a first end coupled to a first end of the left push bar assembly 112*b* and a second end coupled to the first end of the hydraulic cylinder 164. A fourth pair of spreader bars 162 may have a first end coupled to a second end of the left push bar assembly 112*b* and a second end coupled to the second end of the hydraulic cylinder 164.

When the hydraulic cylinder 164 is extended, the eight spreader bars 162 are generally moved toward a perpendicular alignment that maximizes a separation between the left bottom frame member 106*b* and the left push bar assembly 112*b*. When the hydraulic cylinder 164 is contracted, the eight spreader bars 162 are moved toward forming acute angles with the left bottom frame member 106*b* and the left push bar assembly 112*b*, which minimizes the separation between the left bottom frame member 106*b* and the left push bar assembly 112*b*. The right bottom frame member 106*a* and the right push bar assembly 112*a* are similarly coupled and operated by another eight spreader bars 162 and another hydraulic cylinder 164.

Figure 5:
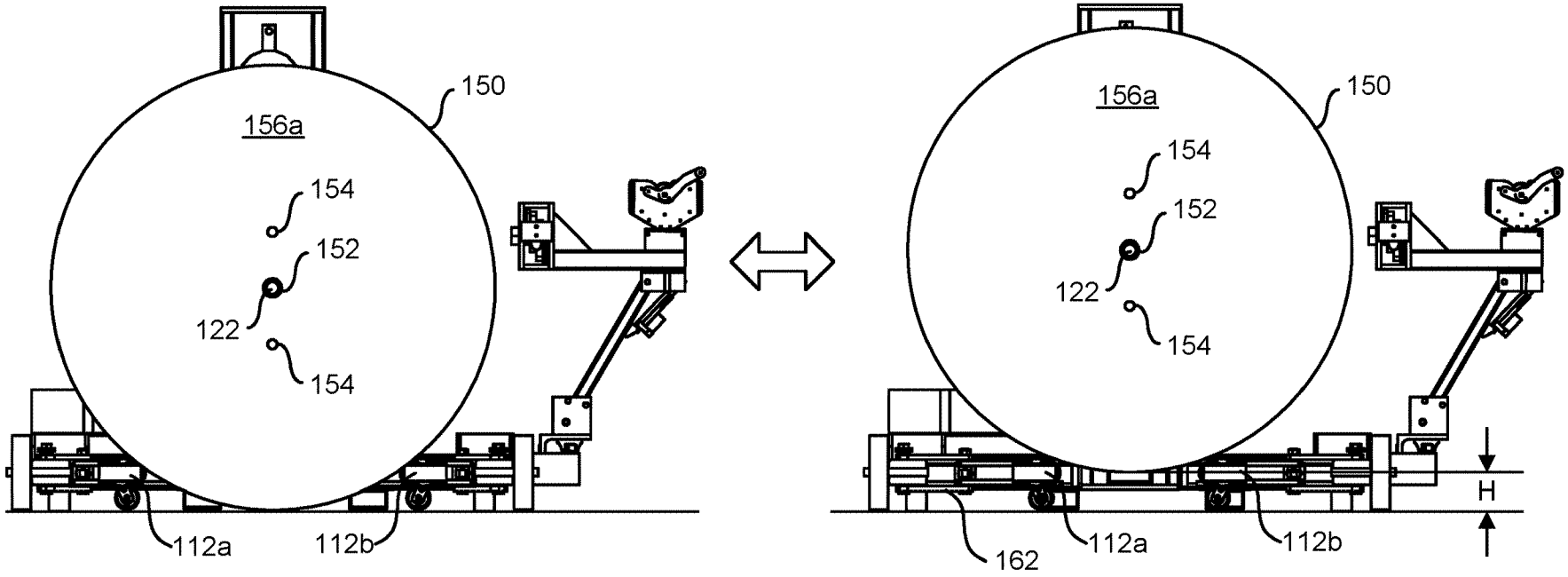
FIG. 5 is a diagram illustrating lifting and lowering operations of the reel take-up apparatus in accordance with an example embodiment of the invention.

Referring to FIG. 5, a diagram is shown illustrating lifting and lowering operations of the reel take-up apparatus 100 in accordance with an example embodiment of the invention. When the separations between (i) the right bottom frame member 106*a* and the right push bar assembly 112*a* and (ii) the left bottom frame member 106*b* and the left push bar assembly 112*b* are maximized (e.g., by extending the respective hydraulic cylinders 164), the reel 150 is generally lifted off a surface (e.g., floor) a pre-defined distance H. When the separations between (i) the right bottom frame member 106*a* and the right push bar assembly 112*a* and (ii) the left bottom frame member 106*b* and the left push bar assembly 112*b* are minimized (e.g., by contracting the hydraulic cylinders 164), the reel 150 is generally lowered back onto the surface.

Figure 6:
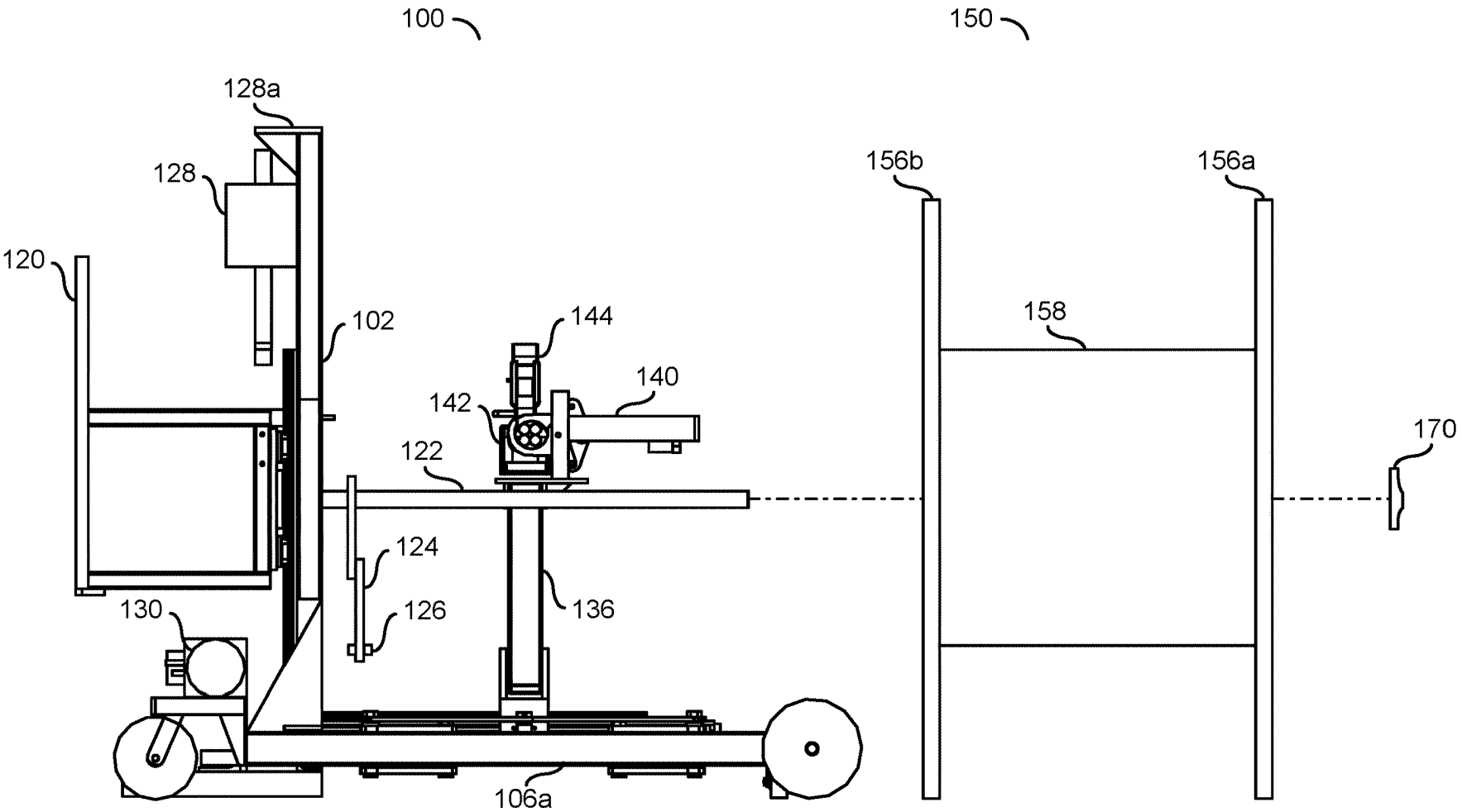
FIG. 6 is a diagram illustrating assembly of an empty reel to the reel take-up apparatus in accordance with an example embodiment of the invention.

Referring to FIG. 6, a diagram is shown illustrating assembly of an empty reel 150 to the reel take-up apparatus 100 in accordance with an example embodiment of the invention. In an example, an operator may use the handle that is part of the modular push handle assembly 120 surrounding the drive mechanism to move the reel take-up apparatus 100 over to an empty reel 150 sitting on a shop floor. The operator places the right roller sub-assembly and the left roller sub-assembly on either side of the reel 150, and makes sure the cantilevered shaft 122 is inserted into the center arbor opening 152 of the reel 150. The reel 150 generally comprises the center barrel (or hub or core) 158 and the two flanges 156*a* and 156*b*.

In general, the unconnected end of the shaft 122 is configured to go into (e.g., spear) the center arbor hole 152 of the reel 150. The shaft 122 is generally inserted into the center arbor hole 152 of the reel 150 until the flange 156*b* of the reel 150 (e.g., the flange nearest the vertical frame member 102) comes into contact with the knuckle arm assembly 124. The knuckle arm assembly 124 may then be attached to the reel 150 by passing the drive pin 126 through a hole in the knuckle arm assembly 124 and into one of the one or more drive holes 154 of the reel 150. The drive pin 126 is generally secured to the knuckle arm assembly 124 (e.g., using a cotter pin, etc.). The unconnected end of the shaft 122 is generally used to spear (or skewer) the reel 150. A locking collar 170 may then be placed on and fastened (e.g., using one or more set screws, etc.) to the unconnected end of the shaft 122 to lock the reel 150 onto the reel take-up apparatus 100. Instead of having to handle a separate shaft every time a reel is loaded as in traditional machines, the shaft 122 stays with the reel take-up apparatus 100 and is held in position at one end, while the unconnected end is used to spear the reel 150.

Figure 10:
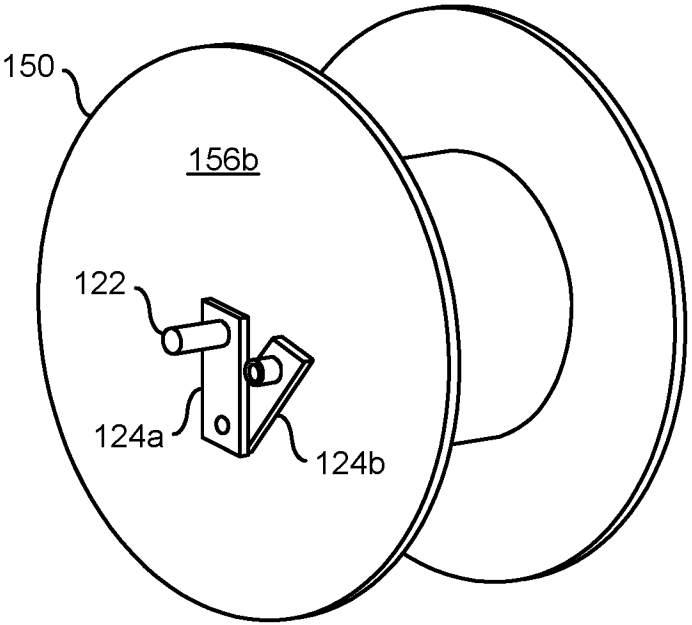
FIG. 10 is a diagram illustrating the knuckle arm assembly align with a drive hole of the reel loaded on the reel take-up apparatus in accordance with an example embodiment of the invention.
Figure 9:
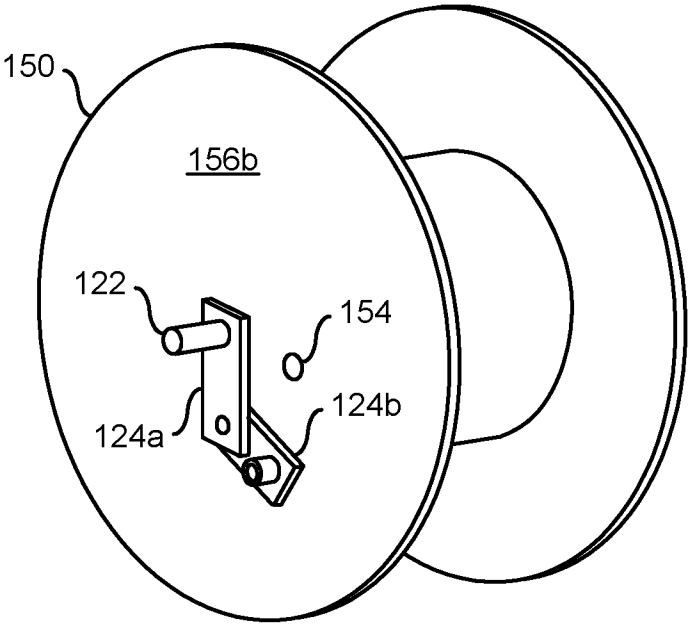
FIG. 9 is a diagram illustrating the knuckle arm assembly prior to being attached to a reel loaded on the reel take-up apparatus in accordance with an example embodiment of the invention.

When the reel 150 is between the right roller sub-assembly and the left roller sub-assembly and the shaft 122 is extending past the flange 156*a*, which is more distal from the vertical frame member 102, the operator may assemble the knuckle arm 124 to the reel 150 such that drive pin 126 extends through the knuckle arm 124 toward the reel 150 and engages one of the one or more drive holes 154 in the flange 156*b* of the reel 150 (e.g., illustrated in FIGS. 9 and 10). The operator may also assemble the locking collar 170 to the shaft 122 to lock the reel 150 in position on the reel take-up apparatus 100. The operator may then actuate hydraulics to move the rollers 118*a* and 118*b* under the flanges 156*a* and 156*b* of the reel 150 to lift the reel 150 off the floor.

The rollers 118*a* and 118*b* generally support the flanges 156*a* and 156*b* of the reel 150 while the reel 150 is turned (rotated) by the drive mechanism using the knuckle arm 124 and the drive pin 126. The rollers 118*a* and 118*b* are generally constructed in terms of material strength and hardness to withstand significant loads associated with a fully laden reel 150. In an example, the fully laden reel 150 may weigh as much as 6,000 pounds. In an example, the reel take-up apparatus 100 may be configured to pull wire(s)/cable(s) with a force of as much as 20,000 pounds. In one example, the reel 150 may be forty-two inches wide and have a diameter of seventy-two inches. However, the reel take-up apparatus 100 may be scaled up or scaled down to accommodate larger or smaller, respectively, capacities.

Figure 7:
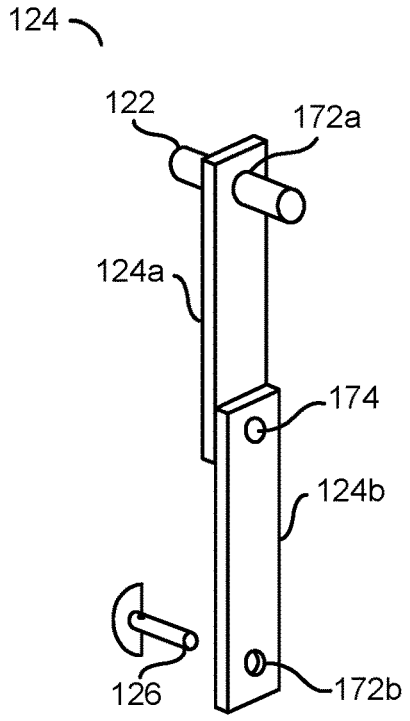
FIG. 7 is a diagram illustrating a knuckle arm assembly of the reel take-up apparatus in accordance with an example embodiment of the invention.

Referring to FIG. 7, a diagram is shown illustrating the knuckle arm assembly 124 of the reel take-up apparatus 100 of FIG. 1. In an example, the knuckle arm assembly 124 may comprise a first portion 124*a* and a second portion 124*b*. The first portion 124*a* may have a hole 172*a*. The hole 172*a* is generally configured to allow the first portion 124*a* to be connected to the shaft 122. In an example, the hole 172*a* may be sized to allow the shaft 122 to pass through. The second portion 124*b* may have a hole 172*b*. The hole 172*b* is generally configured to receive the drive pin 126. The first portion 124*a* and the second portion 124*b* are generally rotatably connected by a pivot 174. The pivot 174 generally allows the knuckle arm assembly 124 to adjust to variations in positions of the drive hole 154 on different reels.

Figure 8:
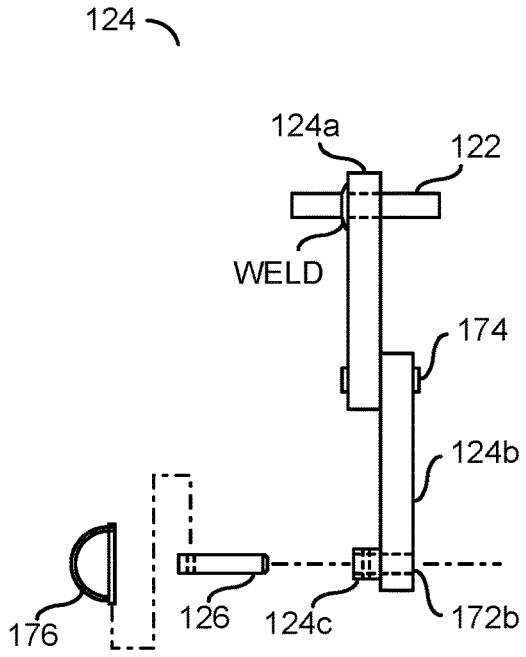
FIG. 8 is a diagram illustrating the knuckle arm assembly of the reel take-up apparatus in accordance with an example embodiment of the invention.

Referring to FIG. 8, a diagram is shown illustrating a lateral view of the knuckle arm assembly 124 of FIG. 7. In an example, the knuckle arm assembly 124 may be welded to the shaft 122. However, other methods of attaching the knuckle arm assembly 124 to the shaft 122 (e.g., a spline, etc.) may be used. The knuckle arm assembly 124 is generally configured to be coupled to the drive hole 154 of the reel 150 by insertion of the drive pin 126 through the hole 172*b*. In an example, the second portion 124*b* of the knuckle arm assembly 124 may comprise a collar (or sleeve) 124*c*. The drive pin 126 may pass through the sleeve 124*c* into the hole 172*b*. The sleeve 124*c* may comprise a pair of holes configured to allow a pin 176 to be inserted perpendicular to the drive pin 126 and pass through a hole in the drive pin 126 to lock the drive pin 126 to the knuckle arm assembly 124. The pin 176 be configured to be locked in place (e.g., by bending, by a D-clip, etc.).

Referring to FIGS. 9 and 10, diagrams are shown illustrating the knuckle arm assembly 124 being attached to the reel 150 loaded on the reel take-up apparatus 100 in accordance with an example embodiment of the invention. The reel 150 is generally loaded onto the reel take-up apparatus 100 between the right roller sub-assembly and the left roller sub-assembly, with the shaft 122 extending through the center arbor hole 152 of the reel 150 and the flange 156*b* of the reel 150 abutting the knuckle arm assembly 124. The operator may rotate the second portion 124*b* of the knuckle arm assembly 124 to align the hole 172*b* with the drive hole 154 of the reel 150. The drive pin 126 may then be placed in the hole 172*b* of the knuckle arm assembly 124 to engage the drive hole 154 in the flange 156*b* of the reel 150.

Figure 11:
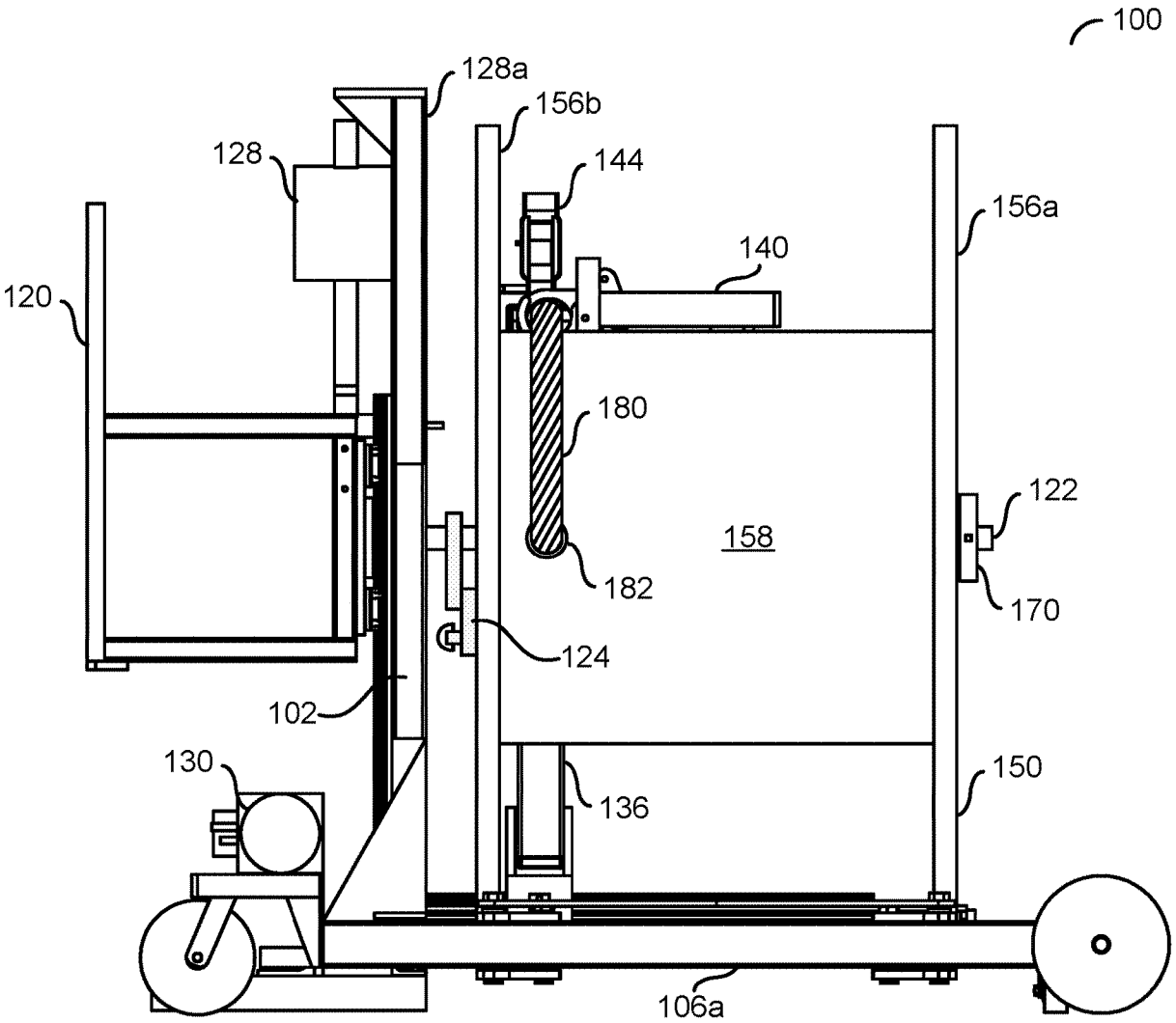
FIG. 11 is a diagram illustrating wire(s) or cable(s) being attached to an empty reel prior to winding.

Referring to FIG. 11, a diagram is shown illustrating wire(s) being attached to an empty reel prior to winding. The reel take-up apparatus 100 is generally configured to pull multiple wires (or cables) onto an empty reel. In an example, the reel take-up apparatus 100 may be used for pulling four copper service entry cables from master reels weighing about 5,000 lbs. each. This process is generally referred to as "Paralleling." In an example, after an empty reel 150 is loaded onto the reel take-up apparatus 100, a single cable may be placed through the wire measuring assembly 144 and three cables may be placed through the wire guide 142. The four cables may then be threaded through the wire clamp 140. The wire clamp 140 generally aids in a tighter grouping of the cables during winding (take-up) and maintains tension when reeling is complete and the cables are fastened to the reel 150. In one example, a group of wires (or cables) 180 may be fed through a hole 182 in the core 158 of the reel 150. In another example, the group of wires (or cables) 180 may be fastened to the reel 150.

In general, a cable (or cables) may be attached to the reel 150 in several ways. Wooden reels 150 typically need cables to be stapled to a flange 156*a* or 156*b*, or to the core 158. Steel reels either have a securing hole (e.g., the hole 182), or a bar that is recessed into one of the flanges 156*a* and 156*b*. In an example, a steel reel with a recessed bar may have one end of a rope tied around the recessed bar and a second end of the rope secured to the cable(s) with tape and/or special knots. In various embodiments, an advantage of the reel take-up apparatus 100 is that an operator may get right to the reel 150 as soon as the group of wires (or cables) 180 is fed through the wire guide 144, the wire measuring assembly 142, and the wire clamp 140, and attach the group of wires (or cables) 180 to the reel 150. In contrast, with existing machines, the operator has to fish the wire over the entire machine and then attach the wire to the reel, which is very difficult. A significant benefit of the reel take-up apparatus 100 in accordance with embodiments of the invention is that loading the wire is much easier and saves a significant amount of time and, therefore, cost.

Figure 12:
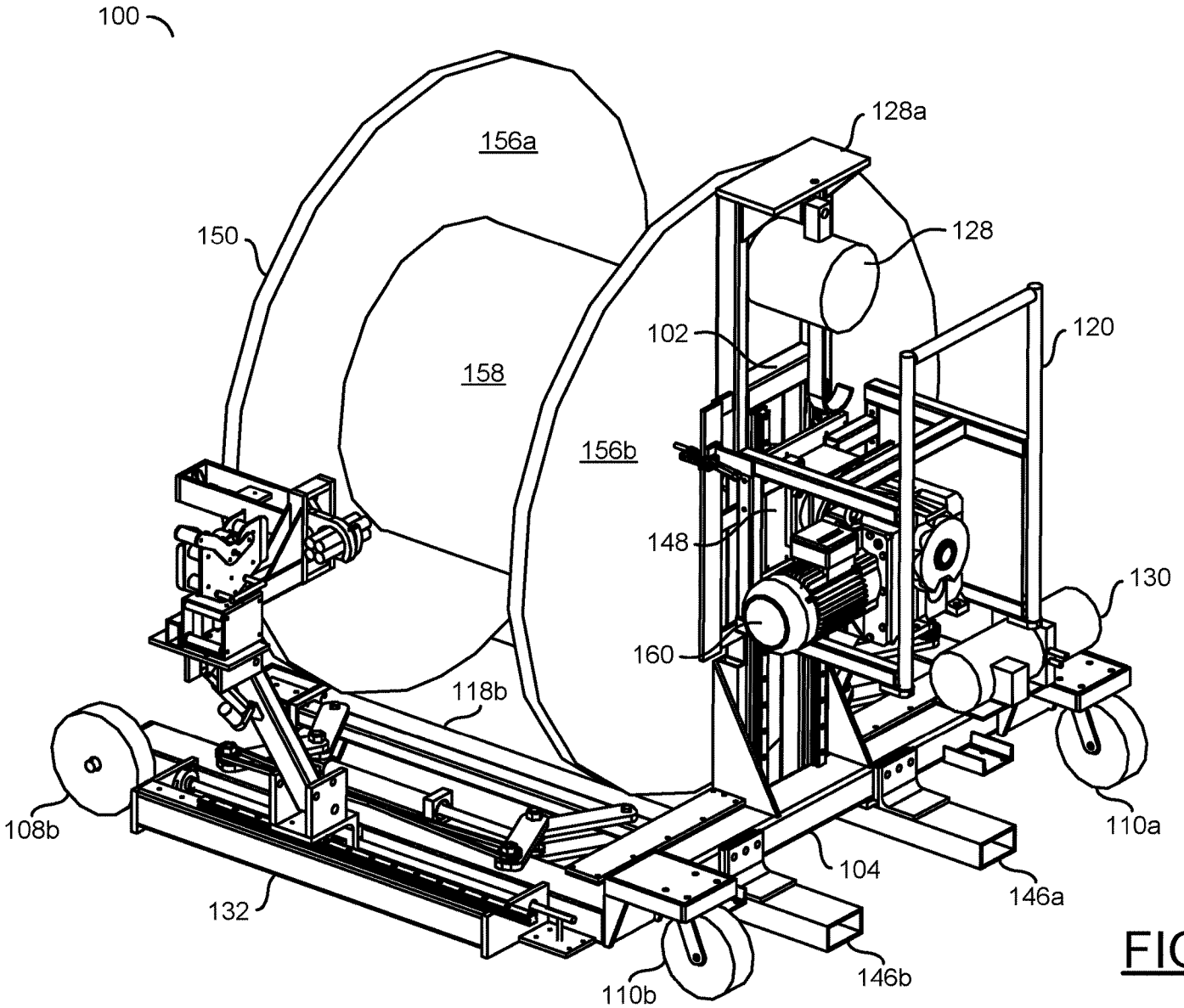
FIG. 12 is a diagram illustrating a drive mechanism of the reel take-up apparatus in accordance with an example embodiment of the invention.

Referring to FIG. 12, a diagram is shown illustrating a rear perspective view of the reel take-up apparatus 100 in accordance with an example embodiment of the invention. In an example embodiment, the drive mechanism enclosed in the modular push handle assembly 120 comprises the bevel geared motor 160. In an example, the bevel geared motor 160 comprises an electric motor integrated with a gearbox. In an example, the bevel geared motor 160 of the reel take-up apparatus 100 may be configured to act as a brake motor. When the rotation of the reel equals zero rotations per minute (rpm), the bevel geared motor 160 may be engaged as a brake, maintaining a position of the reel 150. The cable clamp 140 generally maintains tension when cables are cut. In an example, the bevel geared motor 160 and the wire clamp 140 may engage simultaneously to maintain tension apart from free spinning master reels.

Figure 13:
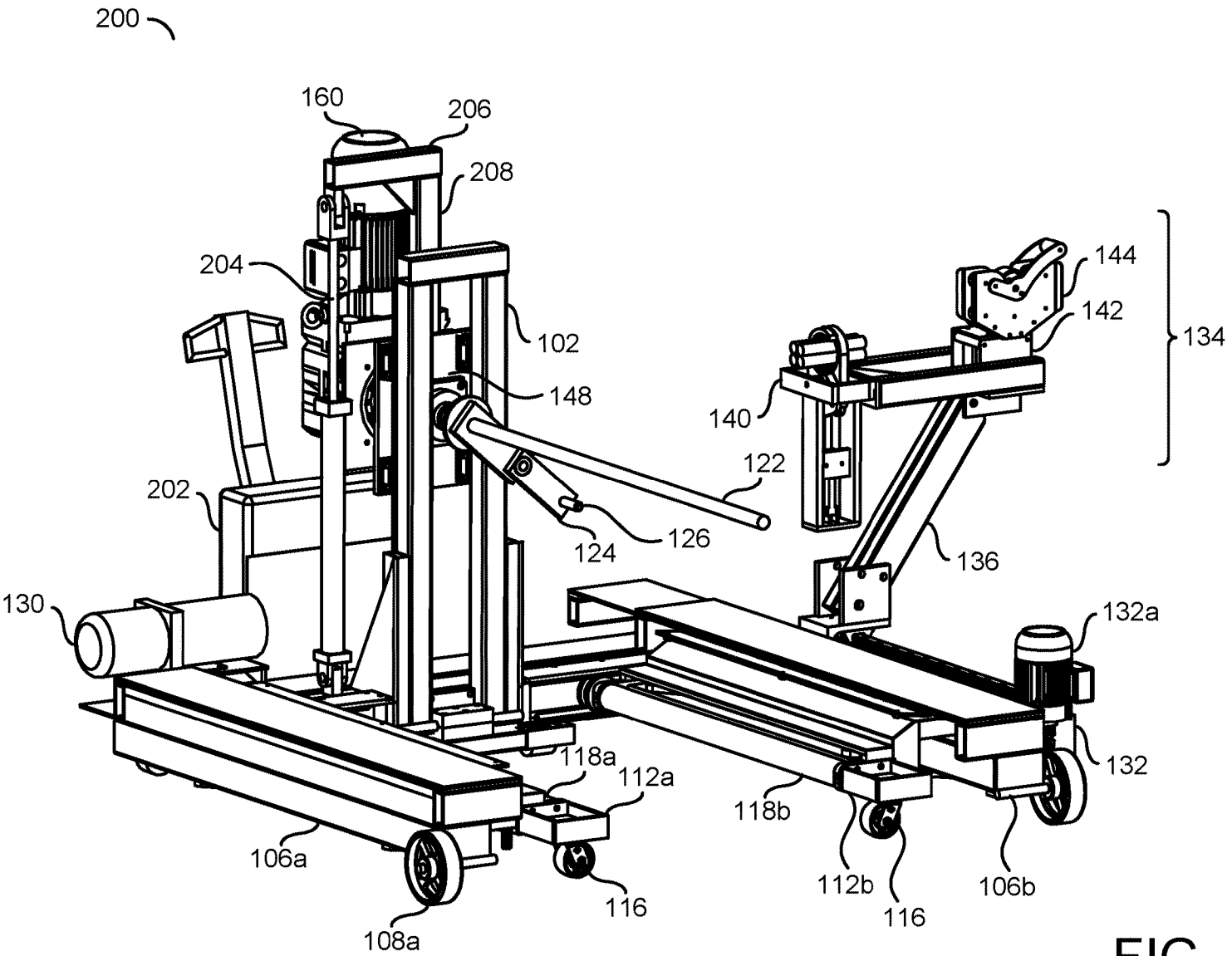
FIG. 13 is a diagram illustrating a reel take-up apparatus in accordance with another example embodiment of the invention.

Referring to FIG. 13, a diagram is shown illustrating a reel take-up apparatus (or machine) 200 in accordance with another example embodiment of the invention. In an example embodiment, the reel take-up apparatus 200 may be implemented similarly to the reel take-up apparatus 100, with the exception of the modular push handle assembly 120 and the tool balancer 128. In an example, the reel take-up apparatus 200 may comprise the vertical frame member (or mast) 102, the frame cross member 104, the right bottom frame member 106*a*, and the left bottom frame member 106*b*. The vertical frame member 102 extends vertically from the center portion of the frame cross member 104. The right bottom frame member 106*a* extends horizontally away at a right angle from the first end of the frame cross member 104. The left bottom frame member 106*b* extends horizontally away at a right angle from the second end of the frame cross member 104. The right bottom frame member 106*a* and the left bottom frame member 106*b* generally extend in the same direction from the frame cross member 104.

In an example embodiment, the reel take-up apparatus 200 may comprise an attached pallet truck and a hydraulic counterbalance system instead of the modular push handle assembly 120 and the tool balancer 128, respectively. In an example, an electric pallet truck 202 may be attached to the frame cross member 104 (e.g., using the fork pockets 146*a* and 146*b*, etc.). The electric pallet truck 202 may allow an operator to maneuver loaded reels more easily and with more accuracy. In an example, the electric pallet truck 202 may be battery powered. In an example, a handle of the electric pallet truck 202 may provide greater operator comfort and reduced steering effort. In an example, the electric pallet truck 202 may provide electrical mechanical brakes to provide good stopping power.

In an example, the hydraulic counterbalance system may comprise a hydraulic cylinder 204, a horizontal lift tube 206, and a vertical lift tube 208. A first end of the hydraulic cylinder 204 is generally connected to the frame cross member 104. A second end of the hydraulic cylinder 204 is generally connected to a first end of the horizontal lift tube 206. A second end of the horizontal lift tube 206 is generally connected to a first end of the vertical lift tube 208. A second end of the vertical lift tube 208 is generally connected to the slide mount plate 148 and the drive mechanism comprising the bevel geared motor 160.

When the hydraulic cylinder 204 is extended, the slide mount plate 148 and the drive mechanism comprising the bevel geared motor 160 are generally moved upward along the vertical frame member 102. When the hydraulic cylinder 204 is contracted, the slide mount plate 148 and the drive mechanism comprising the bevel geared motor 160 are generally moved downward along the vertical frame member 102. In various embodiments, the hydraulic counterbalance system is generally configured to act as a counterbalance for the weight of the drive mechanism. The hydraulic counterbalance system generally allows the drive mechanism to float freely on the vertical frame member 102, allowing the drive mechanism to move up and down as a reel attached to the reel take-up apparatus 200 moves up and down. In various embodiments, the hydraulic motor 130 may be coupled to the positioning actuators of the right side and the left side roller sub-assemblies and the hydraulic cylinder 204. The hydraulic motor 130 is generally configured to provide power to lift and lower the reel and the drive mechanism in a controlled manner.

In various embodiments, the reel take-up apparatus 200 may further comprise the slide wire traverse base (or wire traverse or carriage assembly or level wind) 132. In an example embodiment, the slide wire traverse base 132 may be mounted on a side of the left bottom frame member 106*b* opposite the left push bar assembly 112*b*. In an example, the wire handling assembly 134 is generally attached to the slide wire traverse base 132 by the extension arm 136. The slide wire traverse base 132 is generally configured to move the wire handling assembly 134 back and forth between flanges of a reel mounted on the reel take-up apparatus 200 to facilitate efficient winding of wire/cable on the barrel (or core) of the reel. In an example, the slide wire traverse base 132 may comprise a lead screw and square nut drive mechanism allowing the extension arm 136 to change direction as the wire/cable is being wound. In an example, the slide wire traverse base 132 may be powered by an electric motor 132*a*. In an example, the electric motor 132*a* is generally attached to an end of the slide wire traverse base 132 that is distal from the frame cross member 104. In an example, the wire handling assembly 134 may comprise the wire clamp 140, the wire guide 142, and the wire measurement assembly 144. The slide wire traverse base 132, the extension arm 136, the wire clamp 140, the wire guide 142, the wire measurement assembly 144 may be implemented using conventional devices and/or techniques.

Figure 14:
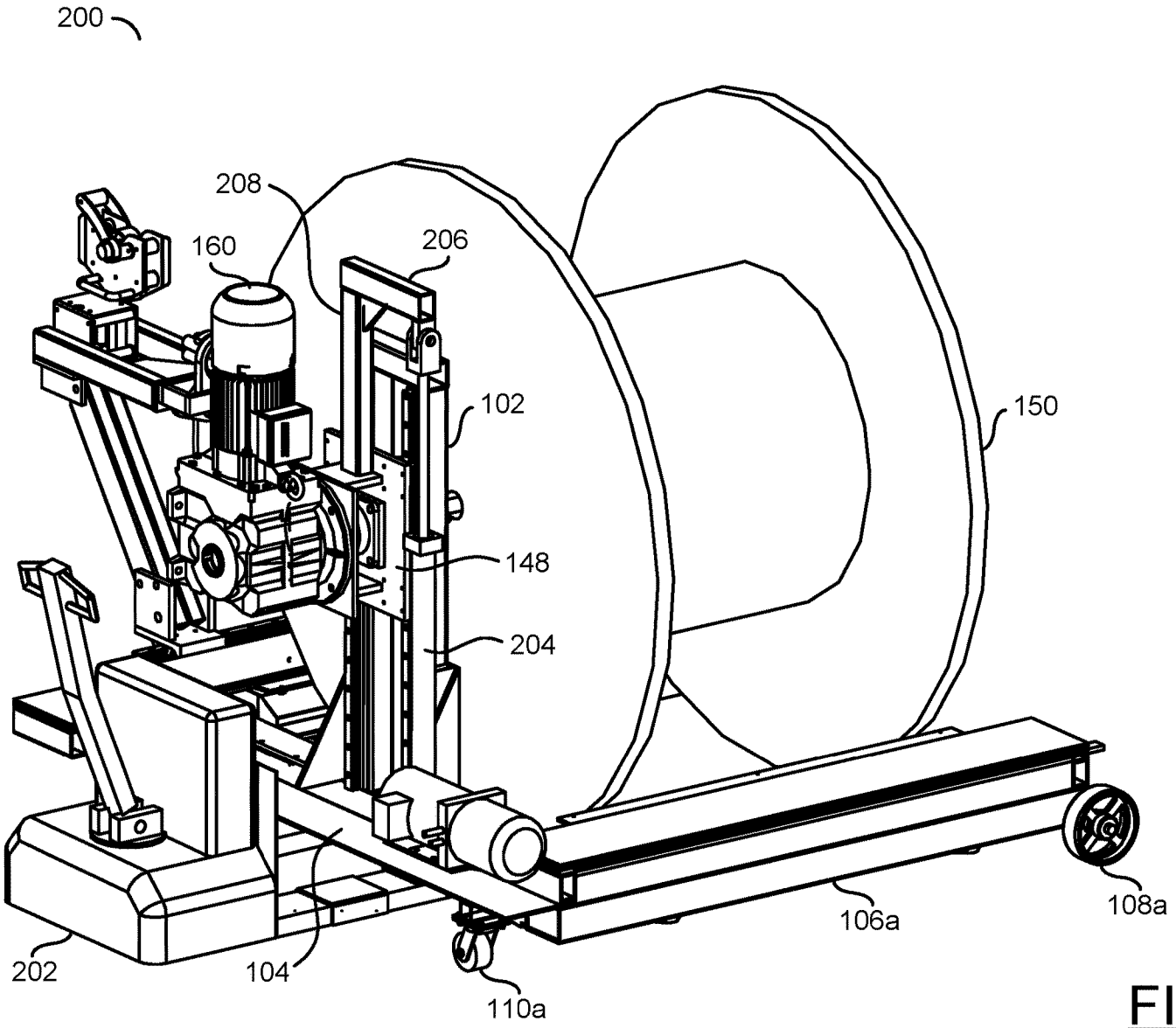
FIG. 14 is a diagram illustrating a rear perspective view of the reel take-up apparatus of FIG. 13 when a reel is being driven.

Referring to FIG. 14, a diagram is shown illustrating a rear perspective view of the reel take-up apparatus 200 in accordance with an example embodiment of the invention. In an example, the bevel geared motor 160 and the vertical lift tube 208 of the hydraulic counterbalance system are connected to a slide mount assembly that includes the slide mount plate 148. In an example, the slide mount plate 148 may comprise four traverse bearings (e.g., one at each corner), which may be slidably attached to rail bearings on each vertical rail (or tube) of the vertical frame member 102. The four traverse bearings and two rail bearings generally allow the drive mechanism to float freely on the vertical frame member 102, allowing the bevel geared motor 160 to move up and down as a reel attached to the reel take-up apparatus 200 moves up and down.

Figure 15:
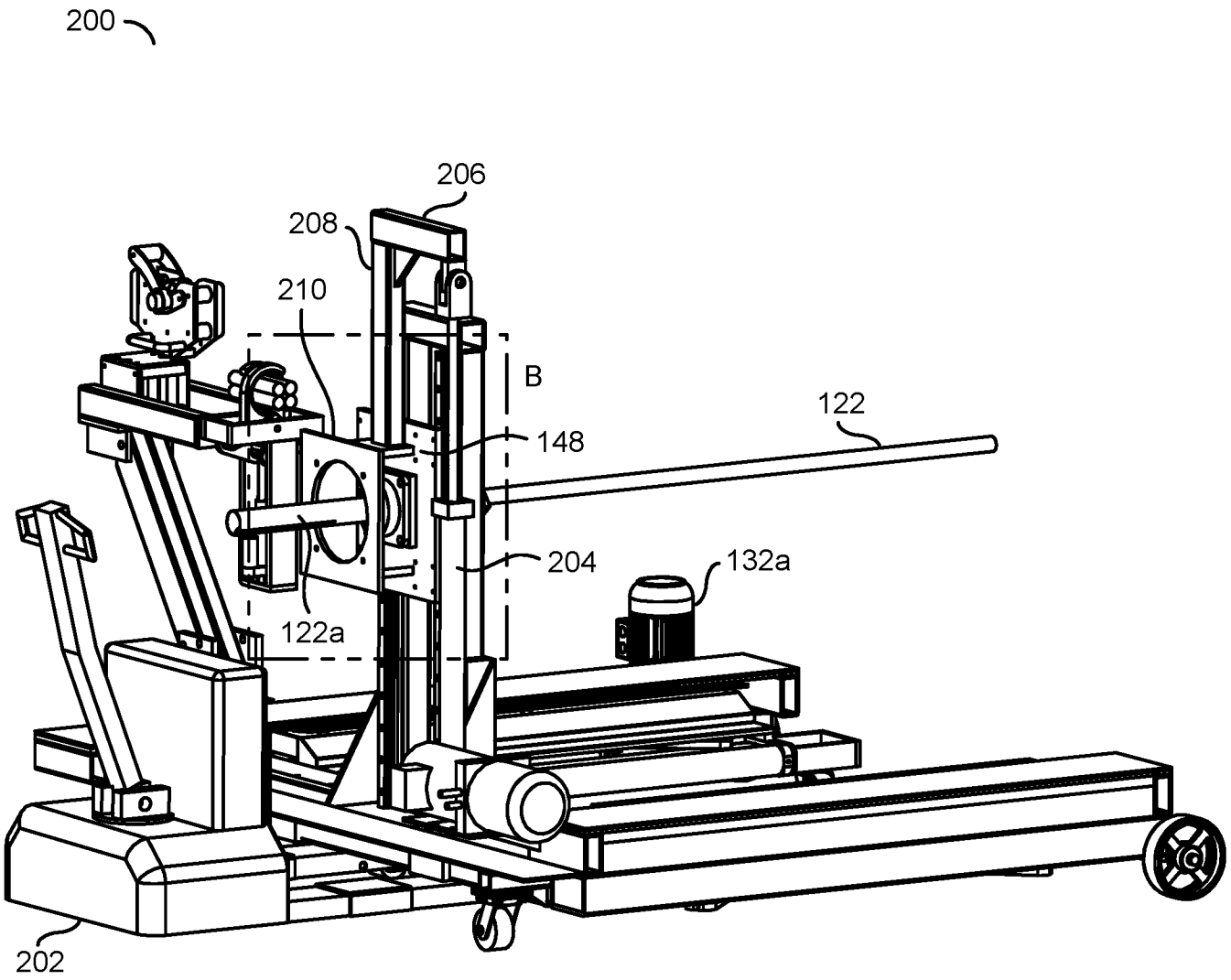
FIG. 15 is a diagram illustrating a drive mechanism of the reel take-up apparatus in accordance with an example embodiment of the invention.

Referring to FIG. 15, a diagram is shown illustrating a drive mechanism of the reel take-up apparatus in accordance with an example embodiments of the invention. The reel take-up apparatus 200 is illustrated with the bevel geared motor 160 omitted for clarity in showing the components of the drive mechanism and the slide mount assembly. In an example, the first end 122*a* of the shaft 122 generally extends from the slide mount plate 148, through a motor mount plate 210, and is inserted into the gearbox of the bevel geared motor 160. In an example, the first end 122*a* may have a slot (or key way) that may be engaged by a shear pin of the bevel geared motor 160. In an example, the bevel geared motor 160 may be slid onto the first end 122*a* of the shaft 122 and fastened to the motor mount plate 210. In another example, the bevel geared motor 160 may be fastened to the motor mount plate 210 and the first end 122*a* of the shaft 122 slid into the gearbox of bevel geared motor 160.

Figure 16:
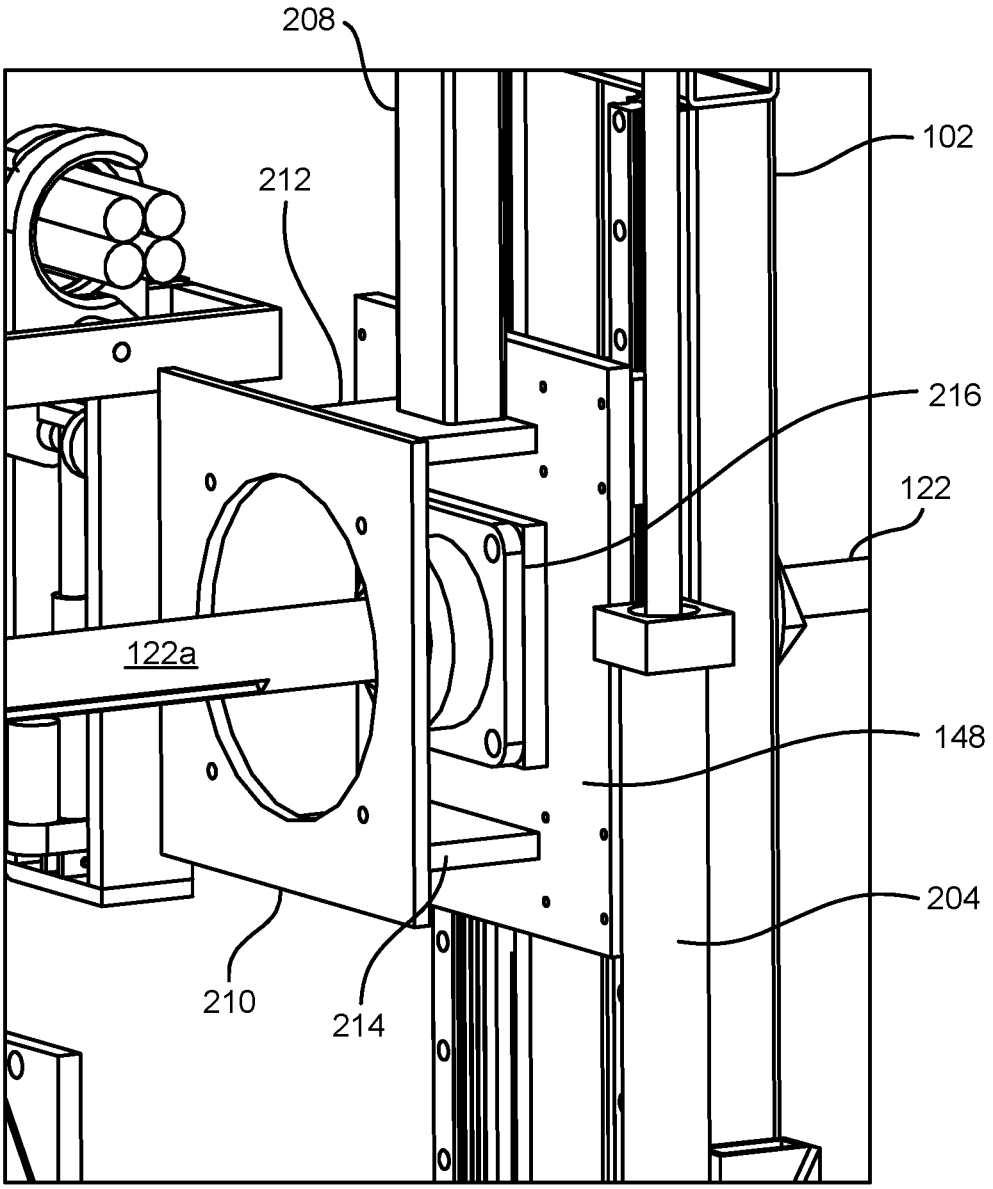
FIG. 16 is a diagram illustrating an enlarged view of a drive mechanism mount of the reel take-up apparatus in accordance with an example embodiment of the invention.

Referring to FIG. 16, an enlarged diagram of the detail B of FIG. 15 is shown illustrating a slide mount assembly of the reel take-up apparatus 200. In various embodiments, the slide mount assembly generally comprises the slide plate 148, the motor mount plate 210, a first motor mount strut 212, and a second motor mount strut 214. The motor mount plate 210 is generally connect to the slide mount plate 148 by the first motor mount strut 212 and the second motor mount strut 214. The second end of the vertical lift tube 208 is generally connected to the first motor mount strut 212 and/or the slide mount plate 148. In an example, a bearing plate 216 through which the shaft 122 passes is mounted on the slide mount plate 148.

Figure 17:
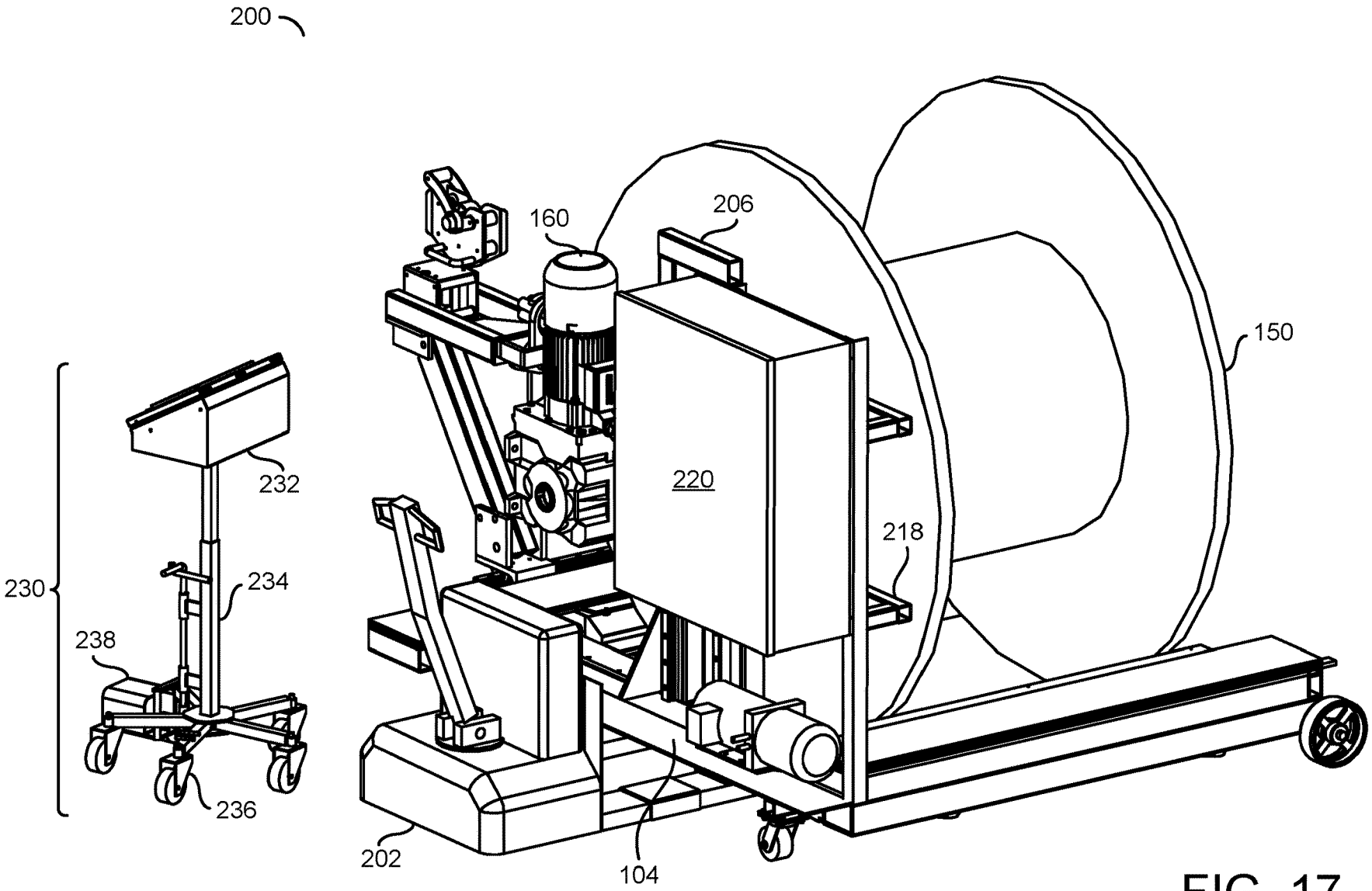
FIG. 17 is a diagram illustrating a rear perspective view of a reel take-up apparatus in accordance with an example embodiment of the invention.

Referring to FIG. 17, a diagram is shown illustrating a rear perspective view of the reel take-up apparatus 200 in accordance with an example embodiment of the invention. In another example embodiment, the reel take-up apparatus 200 may further comprise a cabinet support frame 218, an electrical controls cabinet 220, and a mobile operator station 230. The cabinet support frame 218 is generally mounted to one side of the vertical frame member 102 and the frame cross member 104. The electrical controls cabinet 220 is generally mounted on the cabinet support frame 218. The electrical controls cabinet 220 generally houses electrical control circuitry and hydraulic control circuits for the reel take-up apparatus 200.

In an example, mobile operator station 230 may be configured to allow an operator to control the reel take-up apparatus 200 at a safe distance from the moving parts of the reel take-up apparatus 200. In an example, the mobile operator station 230 may comprise a cabinet 232, a stand 234, a plurality of casters 236, and a foot pedal (or switch) 238. In an example, the cabinet 232 may enclose a human machine interface (HMI) for operating the reel take-up apparatus 200. In an example, the mobile operator station 230 may be configured to communicate with the reel take-up apparatus 200 using a wireless protocol (e.g., WiFi, BLUETOOTH, ZIGBEE, etc.). In an example, the foot pedal 238 may be configured to allow the operator to adjust a height of the mobile operator station 230. In another example, the foot pedal 238 may be configured to provide a safety interlock to ensure the operator is at the mobile operator station 230 and not near the reel take-up apparatus 200.

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. A reel take-up apparatus comprising:

a frame configured to receive a reel from one end;

a drive mechanism slidably mounted to said frame and configured to rotate said reel;

a hydraulic counterbalance system configured to counterbalance a weight of said drive mechanism to allow said drive mechanism to float freely on said frame; and a pair of positioning actuators configured to move a pair of support rollers toward and away from each other so as to (i) lift said reel from a support surface, (ii) support said reel during rotation by said drive mechanism, and (iii) lower said reel to said support surface for removal from said frame.

2. The reel take-up apparatus according to claim 1, wherein said drive mechanism comprises a shaft extending away from said drive mechanism and configured to slip into a center arbor hole of said reel when said reel is loaded onto said reel take-up apparatus, a knuckle arm assembly, and a drive pin configured to engage a drive pin hole in said reel that is offset radially from said center arbor hole.

3. The reel take-up apparatus according to claim 1, wherein said pair of support rollers are configured to engage flanges of said reel to lift and support said reel.

4. The reel take-up apparatus according to claim 1, wherein said hydraulic counterbalance system comprises a hydraulic cylinder, a horizontal lift tube, and a vertical lift tube.

5. The reel take-up apparatus according to claim 4, wherein:

a first end of said hydraulic cylinder is connected to said frame;

a second end of said hydraulic cylinder is connected to a first end of said horizontal lift tube;

a second end of said horizontal lift tube is connected to a first end of said vertical lift tube; and a second end of said vertical lift tube is connected to said drive mechanism.

6. The reel take-up apparatus according to claim 1, further comprising a hydraulic motor configured to power said pair of positioning actuators and said hydraulic counterbalance system.

7. The reel take-up apparatus according to claim 1, wherein said pair of positioning actuators each comprise a scissor jack mechanism and a hydraulic cylinder configured to extend and retract said scissor jack mechanism.

8. The reel take-up apparatus according to claim 1, further comprising a plurality of caster wheels supporting said frame and allowing said frame to be moved around said reel for loading and unloading.

9. The reel take-up apparatus according to claim 1, further comprising an electric pallet truck attached to said frame and allowing said frame to be moved around said reel for loading and unloading.

10. The reel take-up apparatus according to claim 1, further comprising:

a wire traverse mounted on said frame.

11. The reel take-up apparatus according to claim 10, wherein the wire traverse is mounted such that an operator is enabled to directly access the reel.

12. The reel take-up apparatus according to claim 10, wherein the wire traverse is mounted on a side of a bottom frame member opposite one of said pair of support rollers.

13. The reel take-up apparatus according to claim 10, further comprising:

a cable guide and clamping device mounted on said wire traverse, wherein said wire traverse is configured to move said cable guide and clamping device back and forth between flanges of said reel to maintain an orderly winding and unwinding of cable onto and off of, respectively, said reel.

14. The reel take-up apparatus according to claim 13, wherein said cable guide and clamping device is further configured to measure cable being wound and unwound.

15. The reel take-up apparatus according to claim 14, wherein said cable guide and clamping device is further configured to cut said cable after a predetermined length of cable is measured.

16. The reel take-up apparatus according to claim 13, wherein the cable guide and clamping device are mounted on the wire traverse by an extension arm.

17. The reel take-up apparatus according to claim 16, wherein the wire traverse comprises a lead screw and square nut drive mechanism enabling the extension arm to change direction as cable is being wound.

18. A reel take-up apparatus comprising:

a frame configured to receive a reel from one end;

a drive mechanism slidably mounted to said frame and configured to rotate said reel;

a pair of positioning actuators configured to move a pair of support rollers toward and away from each other so as to (i) lift said reel from a support surface, (ii) support said reel during rotation by said drive mechanism, and (iii) lower said reel to said support surface for removal from said frame;

a wire traverse mounted on said frame; and a cable guide and clamping device mounted on said wire traverse, wherein said wire traverse is configured to move said cable guide and clamping device back and forth between flanges of said reel to maintain an orderly winding and unwinding of cable onto and off of, respectively, said reel.

19. A method of winding cable onto a reel comprising:

positioning a reel take-up apparatus around a reel, wherein said reel take-up apparatus comprises (a) a frame configured to receive said reel from one end, (b) a drive mechanism slidably mounted to said frame and configured to rotate said reel, (c) a hydraulic counterbalance system configured to counterbalance a weight of said drive mechanism to allow said drive mechanism to float freely on said frame, (d) a pair of positioning actuators configured to move a pair of support rollers toward and away from each other so as to (i) lift said reel from a support surface, (ii) support said reel during rotation by said drive mechanism, and (iii) lower said reel to said support surface for removal from said frame, (e) a wire traverse mounted on said frame, and (f) a cable guide and clamping device mounted on said wire traverse, wherein said wire transfer is configured to move said cable guide and clamping device back and forth between flanges of said reel to maintain an orderly winding and unwinding of cable onto and off of, respectively, said reel;

causing said pair of positioning actuators to move said pair of support rollers toward each other until said reel is lifted from a support surface;

causing said hydraulic counterbalance system to lift said drive mechanism to maintain alignment with said reel; and rotating said reel using said drive mechanism to wind cable onto or unwind cable from said reel.

20. The method according to claim 19, further comprising:

causing said pair of positioning actuators to move said pair of support rollers away from each other until said reel is resting on said support surface;

causing said hydraulic counterbalance system to lower said drive mechanism to maintain alignment with said reel; and removing said reel take-up apparatus from around said reel.

* * * * *